United States Patent [19]

Gonzalez Espinosa de Los Monteros

[11] Patent Number: 4,909,001

[45] Date of Patent: Mar. 20, 1990

[54] SYSTEM OF HOUSING AND BUILDING CONSTRUCTION BY MEANS OF PREFABRICATED COMPONENTS

[76] Inventor: Emilio Gonzalez Espinosa de Los Monteros, c/Principe de Vergara 128, 28002, Madrid, Spain

[21] Appl. No.: 209,177

[22] Filed: Jun. 17, 1988

[30] Foreign Application Priority Data

Mar. 17, 1988 [ES] Spain ..... 8800804

[51] Int. Cl.[4] ..... E04B 1/00; E04B 7/02

[52] U.S. Cl. ..... 52/90; 52/251; 52/259

[58] Field of Search ..... 52/251, 259, 375, 90, 52/91, 600, 284, 236.3, 236.8, 236.7

[56] References Cited

U.S. PATENT DOCUMENTS

| | | | |
|---|---|---|---|
| 1,079,152 | 11/1913 | Stenzel | 52/91 |
| 2,164,322 | 7/1939 | Hahn | 52/375 |
| 2,499,886 | 3/1950 | Stevens | 52/91 |
| 3,645,056 | 2/1972 | Gerola | 52/259 |
| 3,712,008 | 1/1973 | Georgiev et al. | 52/251 |
| 3,898,776 | 8/1975 | Cox et al. | 52/91 |
| 3,948,008 | 4/1976 | Goetz | 52/251 |
| 4,398,378 | 8/1983 | Heitzman | 52/251 |
| 4,625,484 | 12/1986 | Oboler | 52/91 |
| 4,759,160 | 7/1988 | Fischer | 52/251 |

FOREIGN PATENT DOCUMENTS

| | | | |
|---|---|---|---|
| 878395 | 10/1942 | France | 52/251 |
| 18886 | 10/1928 | Netherlands | 52/375 |

*Primary Examiner*—David A. Scherbel
*Assistant Examiner*—Caroline D. Dennison
*Attorney, Agent, or Firm*—Morgan & Finnegan

[57] ABSTRACT

System of housing and building construction by means of prefabricated components, which include vertical panels for forming partitions and exterior partition walls, as well as roof members, all based on reinforced concrete. The roof members consist of angle beams that follow the pitch of the roof. These members structurally join partition wall panels belonging to two parallel fronts, which panels are, in turn, braced by panels belonging to partitions. The partition wall panels are further joined to the foundation by means of reinforced wet joints. The roof members and panels also have metal elements opposite each other for connection.

6 Claims, 7 Drawing Sheets

SYSTEM OF HOUSING AND BUILDING CONSTRUCTION BY MEANS OF PREFABRICATED COMPONENTS

BACKGROUND OF THE INVENTION

This invention concerns a system of housing and building construction by means of prefabricated components, which includes front and interior vertical panels and roof members.

In the traditional construction based on prefabricated components, one generally starts with a resistant structure, to which said components are anchored, which fulfill their sealing function in practice.

It is an object of this invention to develop a system of construction in which the prefabricated components act as resistant elements and, at the same time, as elements for joining or structural union of the assembly, resulting in a monolithic construction.

SUMMARY OF THE INVENTION

The system developed according to the invention is characterized in that the roof members structurally join two parallel fronts which, in turn, are braced by means of interior perpendicular partitions and are fastened to the foundation by means of reinforced wet joints and anchored in said foundation.

Also according to the invention, the roof members consist of angle beams that follow the pitch of the roof. These beams each have recesses on top, running from the longitudinal edges, for supporting the covering panels. In addition, the beams are finished off at their ends in parallel cross sections on whose opposite interior surfaces vertical metal plates are fastened. These metal plates project downward for anchoring of the panels belonging to two parallel fronts.

The front panels have metal plates fastened on their upper edges, adjoining the vertical metal plates of the vertical members, which are joined by welding. Furthermore, the front panels have on their vertical edges projecting metal reinforcements which are inserted in wet joints that are formed between each two consecutive panels. The wet joints include reinforcements anchored to the foundation, the reinforcements of the panels meeting in each joint being joined to the reinforcements of said joint.

As for the panels forming the partitions, they are provided with complementary reinforcements that project from their vertical edges for anchoring to the wet joints formed between each two consecutive front panels. Those complementary reinforcements also serve for connection to the assembly of panels belonging to perpendicular partitions. The panels forming the partitions also have metal end and intermediate members on their upper edges. The metal end members are joined together in coplanar panels. These metal end members are also joined with the vertical plates of the roof members when the partition panels bear on the partition wall panels. The metal intermediate members are situated to coincide with the zones of encounter with perpendicular panels for connection with the metal end member belonging to said perpendicular partition.

The union between partition forming panels that bear on each other perpendicularly is further completed by union of the reinforcements of said panels through openings made in each of them and subsequent concrete pouring and sealing of such openings.

The system of the invention is applicable to housing construction of any type, whether semidetached, detached or of any other type of combination, and the houses can be of one or more stories.

The vertical panels can be of any size, and furthermore, the exterior sealing panels can carry a series of recesses and projections on the external face which serve to stiffen the panels and at the same toime give the building a decorative character.

The partition wall panels can be formed by layers of different materials for the purpose of obtaining the heat and sound insulation required by local standards. The thickness of the different layers will depend on the humidity and the maximum and minimum temperatures of the site where the building or house is located.

The partition wall panels can be formed solely on the basis of reinforced concrete and then the different layers of insulating mterial can be placed on their interior surfaces.

As is usual, the different panels can have ducts for electric power, telephone, water lines, etc., or else have the hole or openings marked for the subsequent placement of said lines. Also, as is common, the different panels will be provided with the corresponding spaces for doors and windows.

The characteristics of the invention will be better understood with the following specification, given with reference to the attached drawings, where one preferred embodiment is represented, offered by way of nonlimitative example.

BRIEF DESCRIPTION OF THE DRAWINGS the drawings are described as follows.

Figure 1:
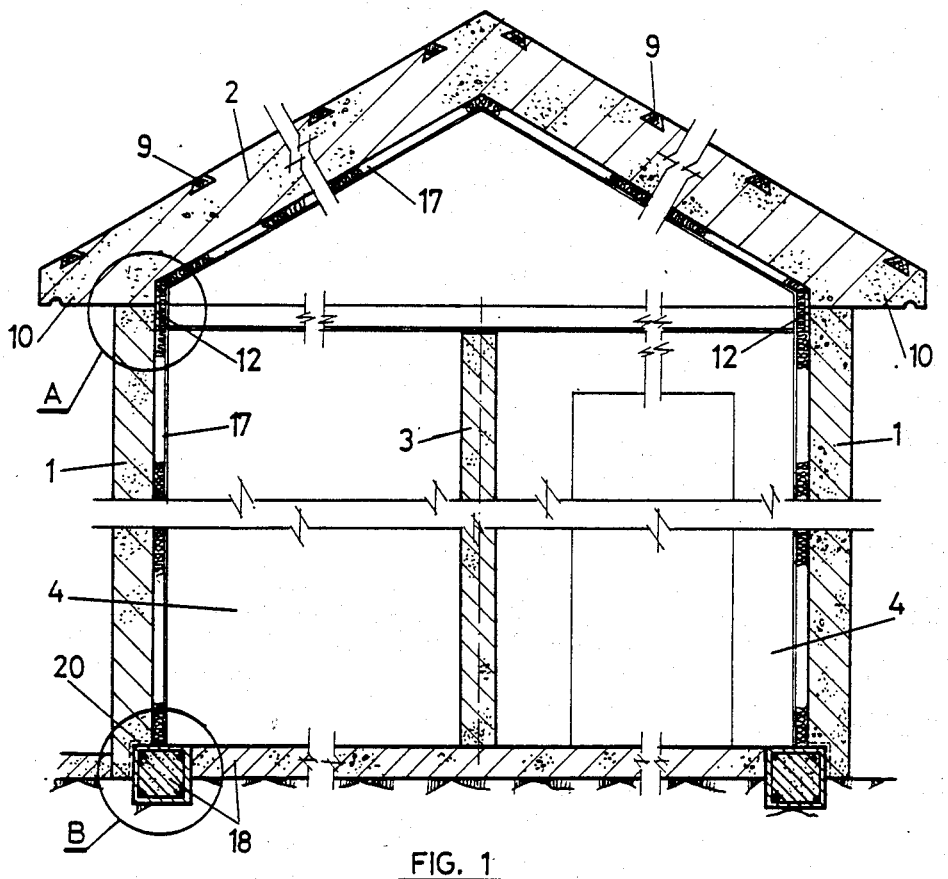
FIG. 1 is a vertical section of a one-story house, built in accordance with the invention.
Figure 3:
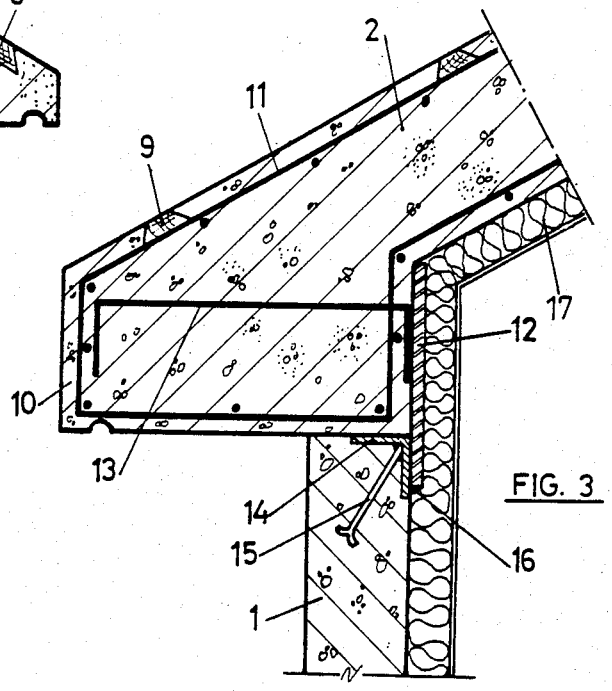
Figure 4:
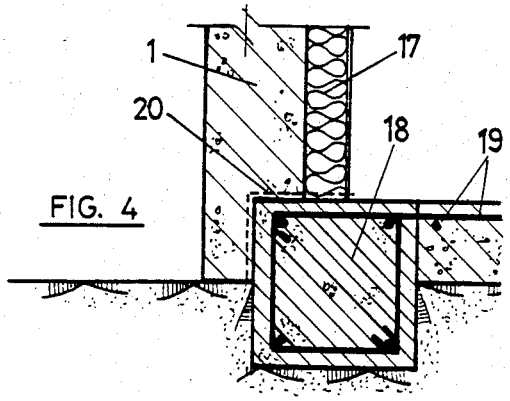
Figure 5:
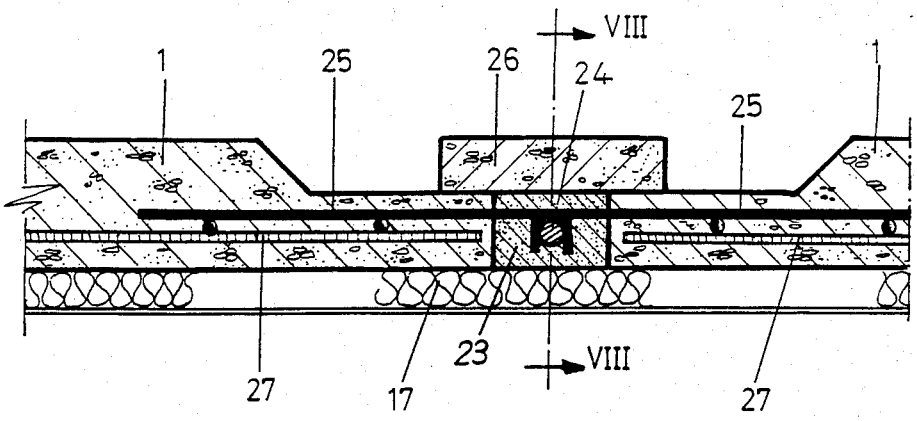

FIG. 3 corresponds to detail A of FIG. 1, on a larger scale;

FIG. 4 corresponds to detail B of FIG. 1, on a larger scale;

FIG. 5 is a horizontal section of one of the front walls, showing the union between two consecutive panels.

Figure 6:
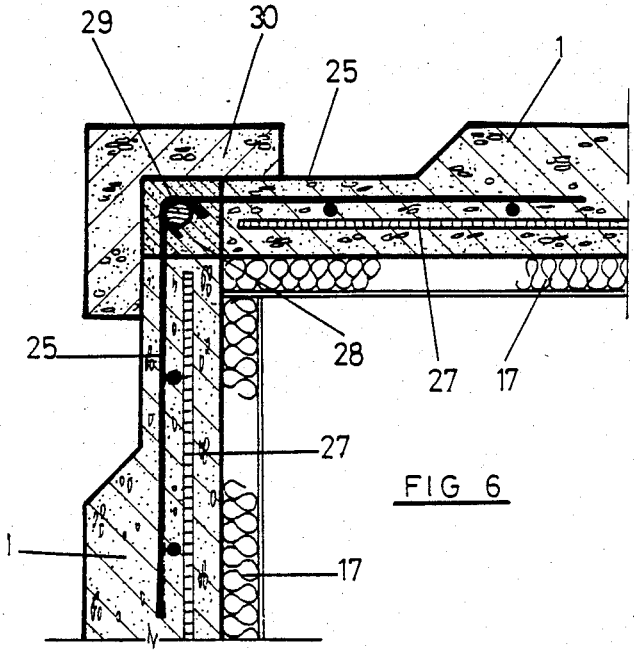
Figure 8:
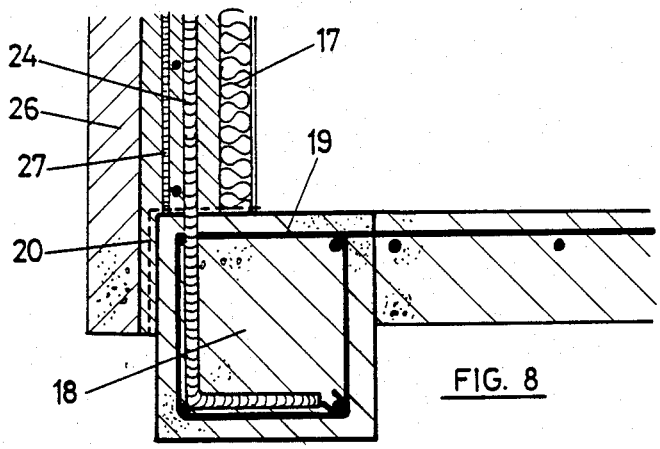
Figure 7:
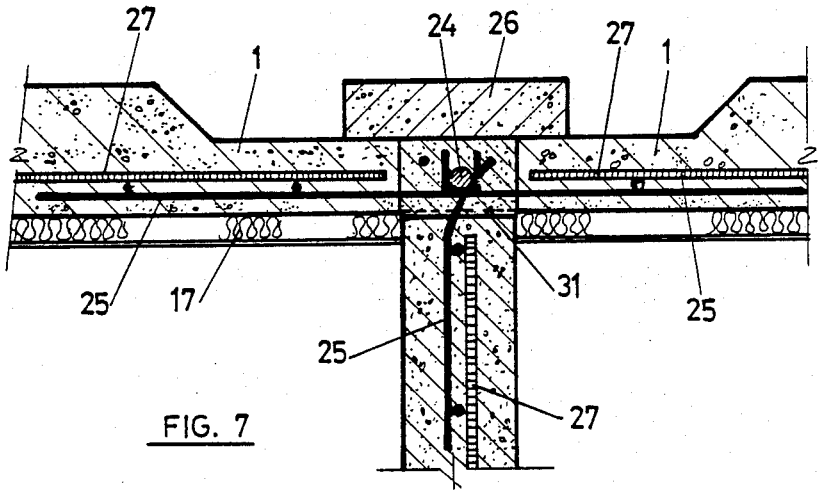
Figure 9:
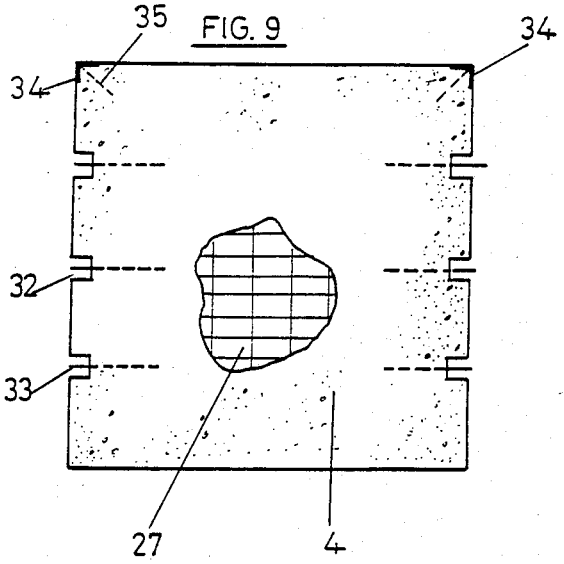
Figure 10:
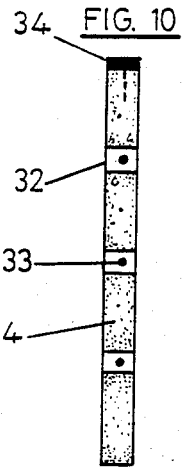
Figure 11:
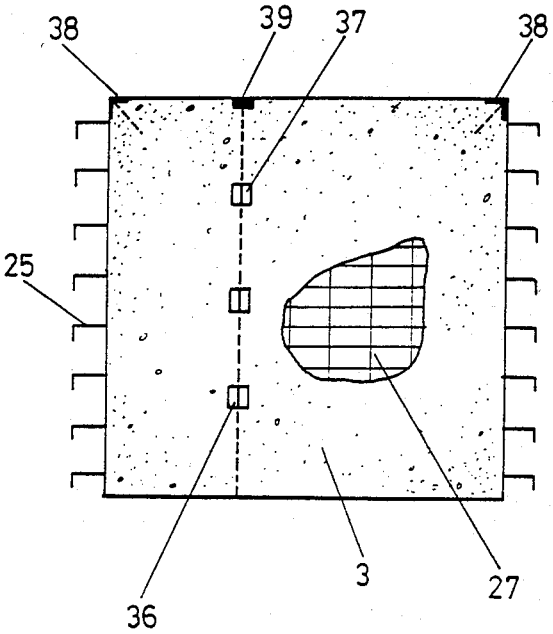
Figure 12:
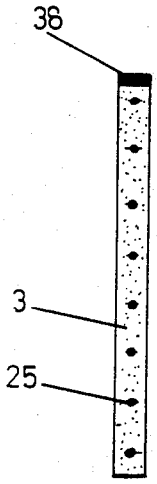
Figure 13:
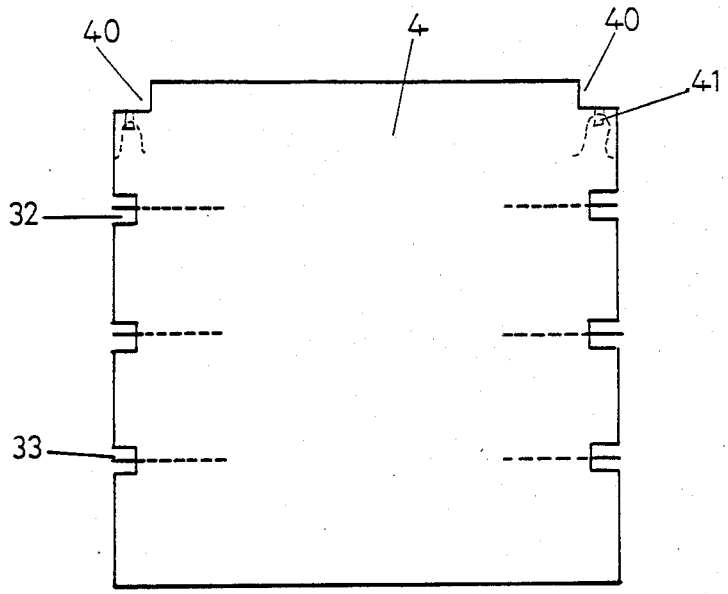
Figure 14:
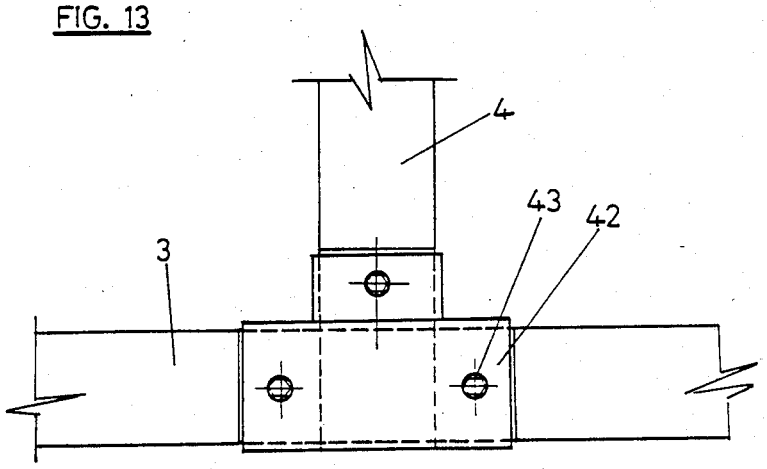
Figure 15:
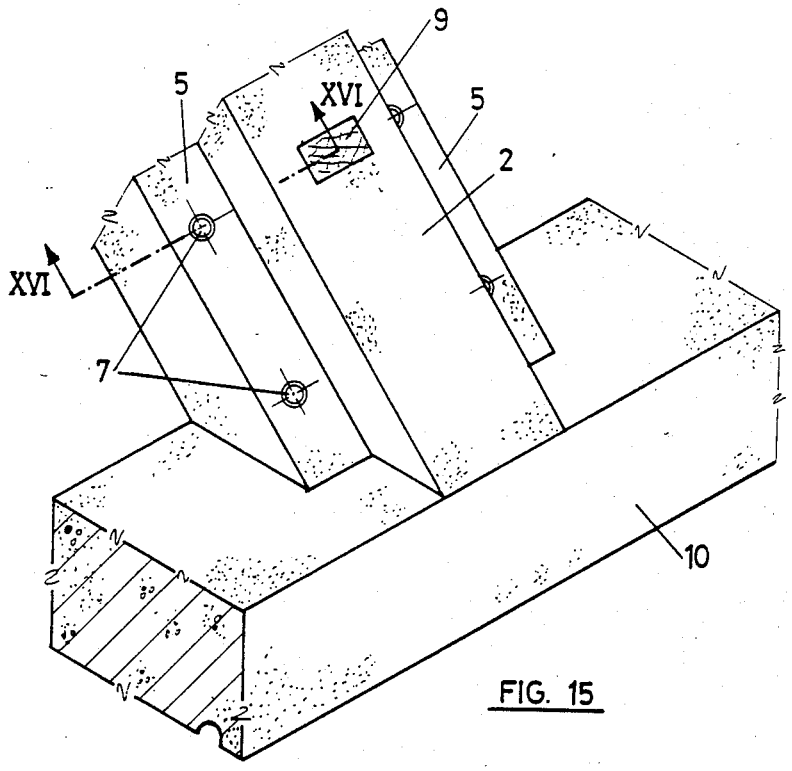

FIG. 6 is a horizontal section of one of the front corners;

FIG. 7 is a view similar to FIG. 5, including a partition bearing on the union between two front panels;

FIG. 8 is a section along line VIII—VIII of FIG. 5;

FIG. 9 is front view of partition forming panel;

FIG. 10 is a profile view of the panel of FIG. 9;

FIGS. 11 and 12 are views similar to FIGS. 9 and 10, where another embodiment of a partition forming panel is shown;

FIG. 13 shows another embodiment of the partition forming panels;

FIG. 14 is a plan view of the union between three partition forming panels;

FIG. 15 is a perspective view of one of the end of the roof members; and

Figure 16:
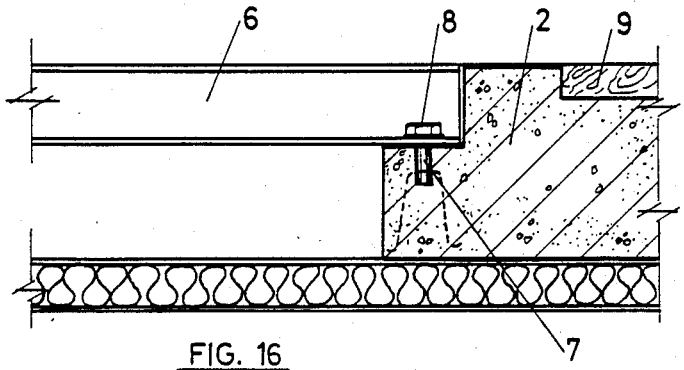

FIG. 16 is a partial cross section, along line XVI—XVI of FIG. 15, including roof plates and insulating layer.

DETAILED DESCRIPTION OF PREFERRED EMBODIMENTS

In FIG. 1, a vertical section of a house is represented, consisting of partition wall or front panels 1, roof members 2 and partition forming panels 3 and 4, all being made on the basis of reinforced concrete.

The roof members 2 consist of angle beams that follow the pitch of the roof. These beams, are represented in FIGS. 15 and 16, each have recesses 5 on top, running from the longitudinal edges, on which the roof panels 6 bear. On the lower surface of the recesses 5 threaded bushings or nuts 7 are embedded for fastening of the panels 6 by means of screws 8. The beams 2 also have wooden blocks 9 embedded for the anchoring of laths. The beams 2 can further be finished off at their ends in parallel cross sections 10.

As can be seen in FIG. 3, the beams 2 are provided with interior reinforcement 11. Fastened to the end cross sections 10, at their interior surface, are vertical plates 12, which project down and can, for example, be welded to the rounds 13 of the beams.

The vertical partition wall panels 1 are provided, on their upper edge and starting from the inner corner, with angle irons 14, as shown in FIG. 3, which can be anchored to rounds 15 embedded in the mass of the panel. The angle irons 14 are joined by weld 16 to the metal plates 12 integral with the roof members 2. In this way, as can be seen in FIG. 1, the roof members 2 structurally join the panels 1 belonging to parallel fronts. The union between sections 14 and plates 12 can also be made by means of screws.

The wooden blocks 9 embedded in the roof members 2 will be used for nailing or fastening the material that will form the waterproofing of the roof.

As show in the figures, a layer of insulating material 17 can be placed on the interior surface of the partition wall panels 1 and of the roof members 2.

In FIG. 4 the support of one of the partition wall panels 1 on the foundation 18 is represented, also formed by means of concrete with reinforcements 19. The continuity of the insulation 17 can be achieved by installing insulating layers 20.

Figure 2:
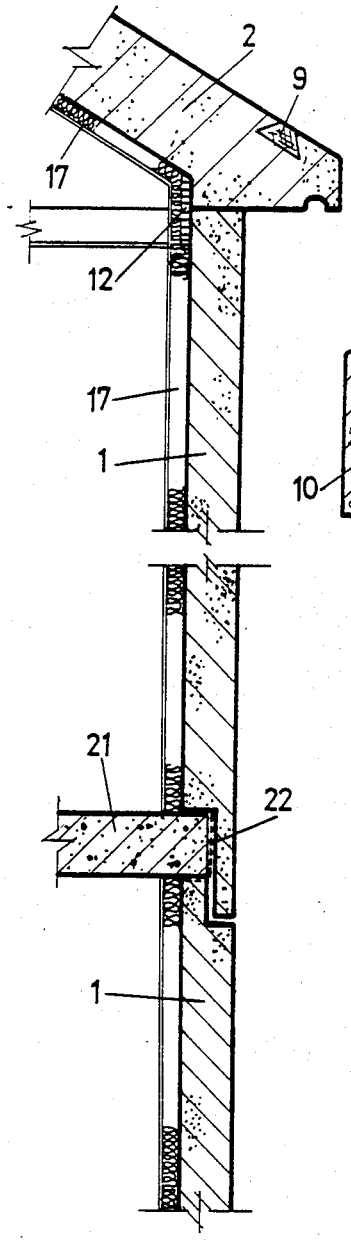
FIG. 2 is a detail in vertical section, similar to FIG. 1, of a house of more than one story.

In FIG. 2 a section of a building with more than one story is represented. The concrete members 21 that form the intermediate slabs and bear on the lower front panels 1 and serve, in turn, as support for the upper front panels 1 are visible. In structures of this type with two or more flood reinforced concrete columns can be used in which the reinforcements of the front panels 1 will be embedded. The continuity of the layers of insulation 17 is achieved, for example, by means of the placement of layers of felt 22 bordering the slabs 22.

In FIG. 5 the union of two consecutive coplanar front panels 1 is shown. Between the panels 1 a wet joint 23 is formed with reinforcement 24. Rounds 25 project from the vertical edges of the panels 1, which are joined to the reinforcement 24 of the joint 23. For the concrete pouring of this joint, a member 26 can be used as form. The reinforcements 27 of the panels 1 also appear in FIG. 5.

In FIG. 6 a front corner formed by the assembly of two panels 1 is represented in horizontal section, between which is formed the concrete joint 28 with reinforcement 29, to which the rounds 25 projecting from the edges of the panels are joined. For concrete pouring of the joint 28, member 30 can be used as form.

In FIG. 7, a view similar to FIG. 5, a partition forming panel 3 is shown meeting the joint 23. The same references as in FIG. 5 are being used.

The panel 3 is provided, like panels 1, with internal reinforcement 27 and with rounds 25 that project on its vertical edges in order to be inserted in the joint 23 and united with the reinforcement 24 of the joint. The continuity of insulation 17 can be achieved by means of the insertion of insulating layers 31.

In FIG. 8, which is a section along line VIII—VIII of FIG. 5, it can be seen how the reinforcement 24 of the wet joint is joined to the reinforcement 19 of the foundation, the same references are being used on this FIG. 8 as on FIGS. 4 and 5 to identify the same components.

In FIGS. 9 to 13 three variant partition forming panels are represented.

In FIGS. 9 and 10 one of the panels 4 is represented with its internal reinforcement 27, their vertical edges having notches 32 through which irons 33 project. The panel 4 is provided at its upper corners with transverse angle irons 34, anchored to the panel, for example, by means of rods 35.

In FIGS. 11 and 12 a panel 3 is represented, which likewise includes an internal reinforcement 27. The vertical edges rounds 25 which project there from, as explained with reference to FIG. 7, are inserted in the wet joint 26. The panel 3 has intermediate opening 36 crossed by a round 37. These openings 36 are situated in the zone of intersection between a panel 3 and a panel 4 and receive the irons 32 of panel 4, which are joined to the rod 37, concrete subsequently being poured through openings 36 and notches 33. Furthermore, panel 3 has angle irons 38 on its upper edge, situated at the corners, and an intermediate metal member 39 opposite the openings 36. The angle iron 34 of the partition 4 bearing on partition 3 is welded to metal member 20. The angle irons 38 of panels 3 and the angle iron 34 of panels 4 are also used for connection between consecutive coplanar partitions forming the same partition.

In FIG. 13 a partition similar to that of FIG. 9 is represented, but further including at its upper corners notches 40 in the lower section of which a nut 41 is driven. With this construction, as can be seen in FIG. 14, by means of a T-shaped intermediate connecting member, three panels can be joined, two of them, identified by number 3, being coplanar and the third, identified by number 4, being perpendicular to the others. Member 42 is provided with holes for the passage of screws 43 that are threaded on the nuts 41.

With the system described, a total bracing between parallel fronts is achieved without the need to lay any horizontal slab as a roof of the house. The roof is formed by placing plates 6, FIG. 16, for laying tiles, slates, etc., and making it possible to place the heat and sound insulation necessary in each case in front.

In the construction described there is a series of vertical reinforcements 24 anchored in the foundation 18 and which, running between vertical panels, form columns or wet joints of reinforced concrete, causing the exterior as well as the interior panels to be interwoven to form a monolithic structure.

The nature of the invention having been sufficiently described, along with the way of putting it into practice, it must be pointed out that the arrangements indicated above and represented on the attached drawings lend themselves to modifications of detail, as long as they do not depart from its fundamental principle.

I claim:

1. A system of housing and building construction by means of prefabricated components, which includes a foundation, vertical panels for forming partitions, vertical wall front panels and roof members, all based on reinforced concrete, wherein the roof members consist of angle beams that follow the pitch of the roof said angle beams being provided at their ends with members forming parallel cross sections on whose opposite interior surfaces are attached vertical metal plates, said plates extending below said member such that when said angle beams are in position on top of said vertical wall front panels to join two parallel fronts said vertical metal plates extend below the top surface of said vertical wall front panels and are attached to opposite inner side walls thereof to act as lateral braces and support, said wall front panels being braced in turn by panels forming partitions, perpendicular to the parallel fronts, and provided with recesses therein for bearing on and being fastened to the foundation by means of wet joints reinforced and anchored in said foundation.

2. A system according to claim 1, further comprising a plurality of covering panels and wherein the angle beams forming the roof members each have on top, running from the longitudinal edges, recesses for receiving and supporting said covering panels.

3. A system according to claim 1, wherein the vertical wall front panels have metal plates fastened on their upper interior edges, aligning with the vertical metal plates of the roof members, to which they are joined by welding, metal reinforcements projecting, furthermore, from the vertical edges of said front panels, which are inserted in wet joints formed between every two consecutive panels, including a vertical reinforcement to which the panel reinforcements are joined.

4. A system according to claim 3, wherein the panels forming the partitions have complementary reinforcements that project from their vertical edges for anchoring to the wet joints uniting vertical wall front panels and for connection to the assembly of panels belonging to perpendicular partitions, said partition panels further being provided at the upper edge with metal end members situated at the corners, which are joined together in coplanar panels and with the vertical plates of the roof members.

5. A system according to claim 4, characterized in that at least part of the panels forming the partitions have metal intermediate members on their upper edge, situated to coincide with points of contact with perpendicular partitions, for connection with the metal end member belonging to said perpendicular partition.

6. A system according to claim 5, characterized in that the union between partition forming panels bearing on each other perpendicularly is accomplished by means of union of the reinforcements of said panels, through openings made in each of said panels and subsequent concrete pouring and sealing of said openings.

* * * * *